US008905767B2

(12) United States Patent
Putt, Jr. et al.

(10) Patent No.: US 8,905,767 B2
(45) Date of Patent: Dec. 9, 2014

(54) CABLE ASSEMBLY AND CONNECTOR MODULE HAVING A DRAIN WIRE AND A GROUND FERRULE THAT ARE LASER-WELDED TOGETHER

(71) Applicant: Tyco Electronics Corporation, Berwyn, PA (US)

(72) Inventors: Robert Lee Putt, Jr., Enola, PA (US); Kenneth W. Ellis, Etters, PA (US); Julia Anne Lachman, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 22 days.

(21) Appl. No.: 13/762,094

(22) Filed: Feb. 7, 2013

(65) Prior Publication Data

US 2014/0220798 A1 Aug. 7, 2014

(51) Int. Cl.

| | |
|---|---|
| ***H01R 4/66*** | (2006.01) |
| ***H01R 43/02*** | (2006.01) |
| ***H01R 9/03*** | (2006.01) |
| ***H01R 13/652*** | (2006.01) |
| *H01R 4/02* | (2006.01) |
| *H01B 11/10* | (2006.01) |

(52) U.S. Cl.

CPC ..... *H01R 13/652* (2013.01); *H01R 43/0221* (2013.01); *H01R 9/034* (2013.01); *H01R 4/029* (2013.01); *H01B 11/1091* (2013.01)

USPC ..... 439/101

(58) Field of Classification Search

USPC ..... 439/101, 108, 607.01

See application file for complete search history.

(56) References Cited

U.S. PATENT DOCUMENTS

| | | | | |
|---|---|---|---|---|
| 4,826,443 | A * | 5/1989 | Lockard | 439/101 |
| 5,632,634 | A | 5/1997 | Soes | |
| 5,681,172 | A | 10/1997 | Moldenhauer | |
| 6,009,621 | A * | 1/2000 | Nishi et al. | 29/857 |
| 7,208,684 | B2 * | 4/2007 | Fetterolf et al. | 174/113 R |
| 7,637,767 | B2 | 12/2009 | Davis et al. | |
| 7,762,846 | B1 | 7/2010 | Whiteman, Jr. et al. | |
| 8,258,402 | B2 * | 9/2012 | Hagi et al. | 174/84 R |
| 2013/0078871 | A1 * | 3/2013 | Milbrand, Jr. | 439/676 |

FOREIGN PATENT DOCUMENTS

| | | | |
|---|---|---|---|
| DE | 102010035424 | A1 | 3/2012 |
| EP | 0670616 | A1 | 2/1995 |
| GB | 946389 | A | 1/1964 |
| JP | H11214113 | A | 8/1999 |
| JP | 2001135418 | A | 5/2001 |

OTHER PUBLICATIONS

John E. Westman,et al.; Cable Header Connector; U.S. Appl. No. 13/585,992, filed Jul. 15, 2012.

U.S. Appl. No. 13/585,992, filed Jul. 15, 2012.

U.S. Appl. No. 13/314,458, filed Dec. 8, 2011.

European Search Report issued in corresponding application No. EP 14153341 completed on May 7, 2014.

* cited by examiner

*Primary Examiner* — Chandrika Prasad

(57) ABSTRACT

A cable assembly including a communication cable. The communication cable includes insulated conductors, a shielding layer that surrounds the insulated conductors, and a drain wire that extends along the shielding layer. The insulated conductors, the shielding layer, and the drain wire extend along a length of the cable to a terminating end of the cable. The cable assembly also includes a ground ferrule that is coupled to the terminating end of the cable. The ground ferrule is intimately engaged with the drain wire along a contact zone, wherein the ground ferrule and the drain wire are laser-welded together for at least a portion of the contact zone.

20 Claims, 5 Drawing Sheets

CABLE ASSEMBLY AND CONNECTOR MODULE HAVING A DRAIN WIRE AND A GROUND FERRULE THAT ARE LASER-WELDED TOGETHER

BACKGROUND

The subject matter herein relates generally to a cable assembly that is configured to electrically interconnect different electrical components, such as connector modules and cable connectors.

At least some types of communication cables have at least one insulated conductor and a drain wire (also referred to as a grounding wire) that extend alongside each other for the length of the cable. The insulated conductor(s) and the drain wire may be surrounded by a shielding layer that, in turn, is surrounded by a cable jacket. The shielding layer includes a conductive foil that, along with the drain wire, functions to shield the insulated conductor(s) from electromagnetic interference (EMI) and generally improve performance. The cables may have a foil-in configuration, wherein the conductive foil faces radially inward, or a foil-out configuration, wherein the conductive foil faces radially outward. The cable jacket, the shielding layer, and the insulation that covers the conductor(s) may be removed (e.g., stripped) at a terminating end of the cable to expose the conductor(s). The drain wire may be mechanically and electrically coupled to a ground ferrule or other shield at the terminating end using, for example, an insulation displacement connector (IDC) termination.

However, communication cables similar to the above may have some undesirable qualities. For example, when attempting to electrically couple the drain wire to a ground ferrule, it may be challenging to control or manipulate (e.g., bend) the drain wire so that the drain wire is properly positioned for terminating to the ground ferrule. In addition, the conductive foil at the terminating end of the cable may be cut or torn when the cable is stripped or when the drain wire is bent to position for terminating. The resulting tear in the foil may increase electromagnetic radiation emission/susceptibility at the terminating end. Such tears in the conductive foil may also cause an unwanted change in impedance at the terminating end.

Accordingly, there is a need for a communication cable that provides effective EMI shielding at relatively low cost.

BRIEF DESCRIPTION

In one embodiment, a cable assembly is provided that includes a communication cable having insulated conductors, a shielding layer that surrounds the insulated conductors, and a drain wire that extends along the shielding layer. The insulated conductors, the shielding layer, and the drain wire extend along a length of the cable to a terminating end of the cable. The cable assembly also includes a ground ferrule that is coupled to the terminating end of the cable. The ground ferrule is intimately engaged with the drain wire along a contact zone, wherein the ground ferrule and the drain wire are laser-welded together for at least a portion of the contact zone.

The ground ferrule may have an interior surface that extends alongside the cable. In some embodiments, the interior surface has a first radius of curvature along the drain wire and a second radius of curvature along an exterior surface of the cable. The first radius of curvature is smaller than the second radius of curvature. In some embodiments, the ground ferrule may include a wire-accommodating portion that defines a cradle recess along the interior surface. The cradle recess may be shaped to receive the drain wire such that the wire-accommodating portion surrounds the drain wire. In some embodiments, the ground ferrule has an exterior surface that is opposite the interior surface. The ground ferrule may include a bonding channel that extends from the exterior surface of the ground ferrule toward the drain wire. The ground ferrule may be welded to the drain wire along the bonding channel.

In another embodiment, a connector module is provided that includes a communication cable having insulated conductors, a shielding layer that surrounds the insulated conductors, and a drain wire that extends along the shielding layer. The insulated conductors, the shielding layer, and the drain wire extend along a length of the cable to a terminating end of the cable. The connector module also includes a contact assembly including signal contacts. The signal contacts are electrically coupled to the insulated conductors of the cable. The connector module also includes a ground ferrule that is coupled to the terminating end of the cable. The ground ferrule is intimately engaged with the drain wire along a contact zone, wherein the ground ferrule and the drain wire are laser-welded together for at least a portion of the contact zone.

In yet another embodiment, a cable connector is provided that includes a housing having a mating face configured to engage a mating connector and a plurality of connector modules supported by the housing. The connector modules are arranged along the mating face. Each of the connector modules includes a communication cable having insulated conductors, a shielding layer that surrounds the insulated conductors, and a drain wire that extends along the shielding layer, wherein the insulated conductors, the shielding layer, and the drain wire extend along a length of the cable to a terminating end of the cable. Each of the connector modules also includes a contact assembly having signal contacts. The signal contacts are electrically coupled to the insulated conductors of the cable. Each of the connector modules also includes a ground ferrule that is coupled to the terminating end of the cable. The ground ferrule is intimately engaged with the drain wire along a contact zone, wherein the ground ferrule and the drain wire are laser-welded together for at least a portion of the contact zone.

DETAILED DESCRIPTION

Figure 1:
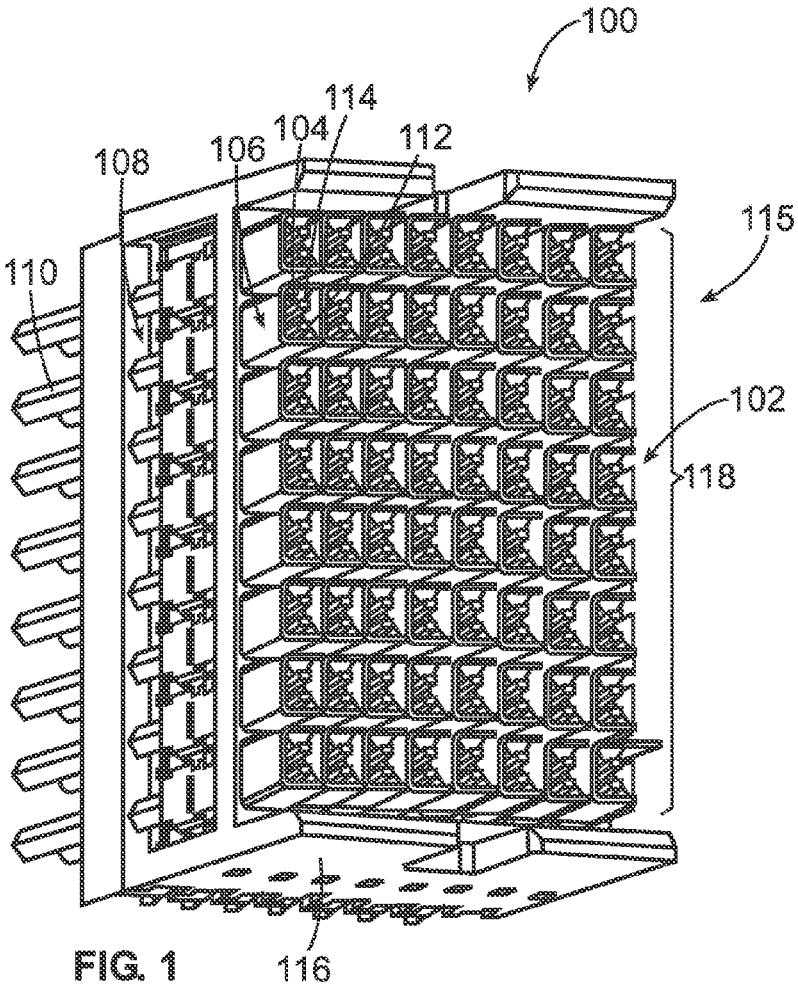
FIG. 1 is a front perspective view of a cable connector including a plurality of connector modules formed in accordance with one embodiment.

FIG. 1 is a front perspective view of a cable connector 100 that includes a plurality of connector modules 102 formed in accordance with one embodiment. Each of the connector modules 102 includes a contact assembly 104, a shield assembly 106 coupled to the contact assembly 104, and a cable assembly 108 that is also coupled to the contact assembly 104 and, optionally, the shield assembly 106. The cable assembly 108 includes a communication cable 110. As shown, the connector modules 102 may be positioned in an array 118 along a mating face 115 of the cable connector 100. The cable connector 100 is configured to be mated with a receptacle connector (not shown), wherein each of the connector modules 102 may engage a corresponding module (not shown) of the receptacle connector. In the illustrated embodiment, each of the connector modules 102 includes first and second signal contacts 112, 114. The signal contacts 112, 114 are at least partially surrounded by the shield assembly 106.

Also shown, the cable connector 100 includes a housing 116 that supports the connector modules 102. The housing 116 holds the connector modules 102 and the cable assemblies 108 in parallel such that the connector modules 102 are aligned in rows and columns in the array 118. FIG. 1 shows one exemplary embodiment, but any number of connector modules 102 may be held by the housing 116 in various arrangements depending on the particular application.

The cable connector 100 is configured to engage the receptacle connector, which may be board-mounted to a printed circuit board or may be another cable connector. In some embodiments, the cable connector 100 is a high speed differential pair cable connector that includes a plurality of differential pairs of conductors. For example, the cable 110 may be configured to transmit data signals at a data rate or speed of 10 Gbps or more. The conductors of the differential pairs are shielded along the signal paths to reduce noise, crosstalk, and other interference.

Figure 2:
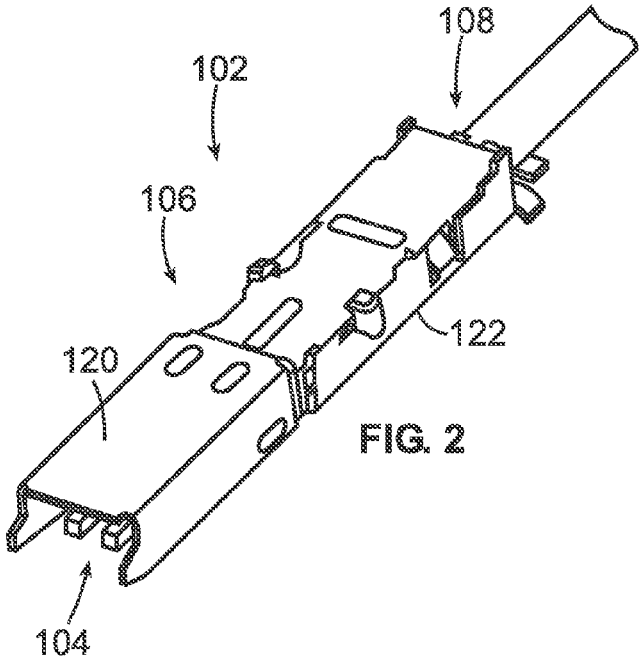
FIG. 2 is a perspective view of one of the connector modules shown in FIG. 1 that is formed in accordance with one embodiment.
Figure 3:
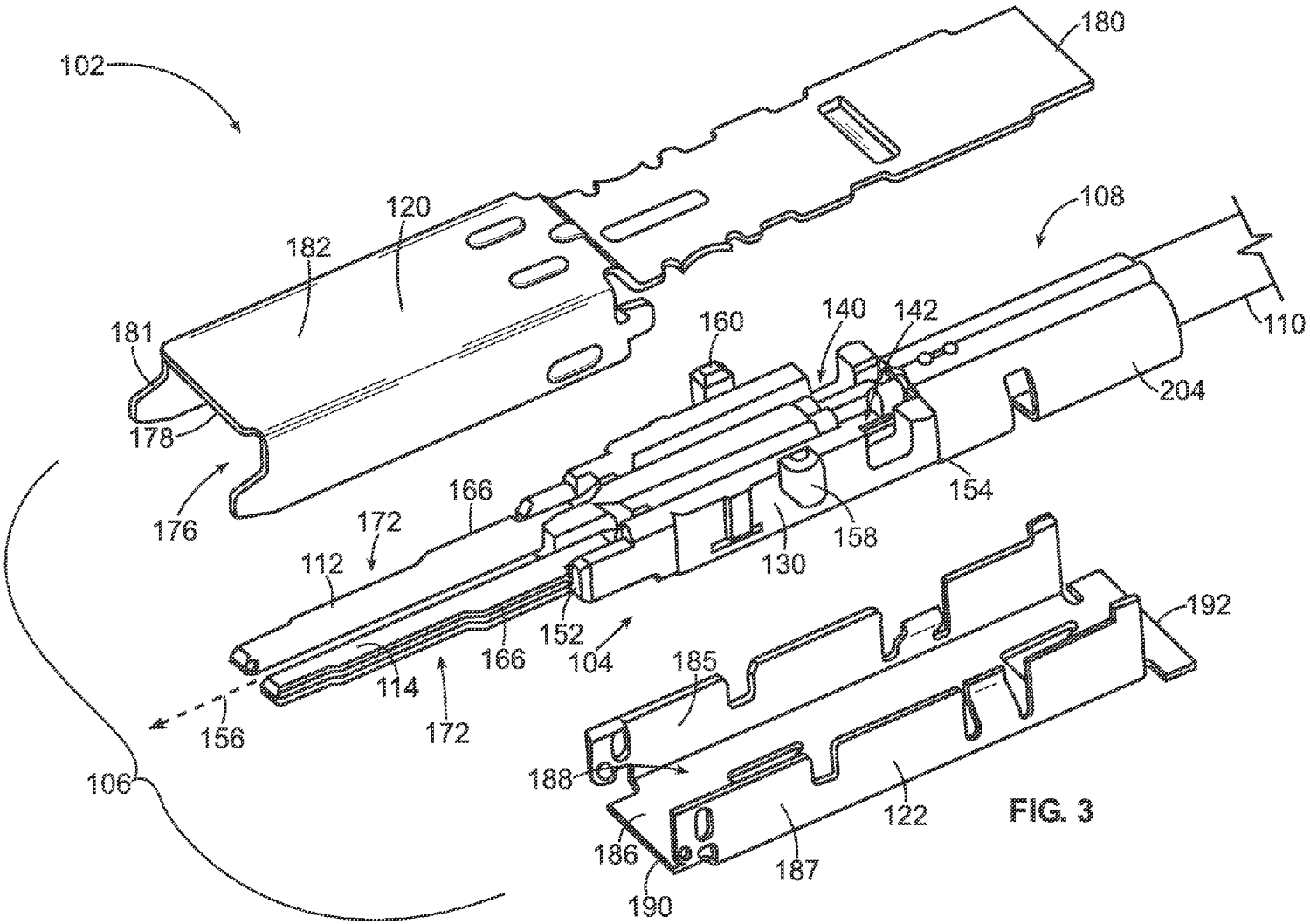
FIG. 3 is an exploded view of one of the connector modules shown in FIG. 1.

FIG. 2 is an isolated perspective of one of the connector modules 102, and FIG. 3 shows an exploded view of the connector module 102. As shown, the connector module 102 includes the cable assembly 108, the shield assembly 106, and the contact assembly 104. The shield assembly 106 may include a first ground shield (or cover shield) 120 and a second ground shield (or base shield) 122 that are configured to be coupled to each other. The contact assembly 104 is located between the first and second ground shields 120, 122 when the connector module 102 is assembled. However, in other embodiments, the shield assembly 106 may include only a single ground shield or, alternatively, the shield assembly 106 may include more than three shielding components.

With respect to FIG. 3, the contact assembly 104 includes a mounting block 130 that is configured to hold the signal contacts 112, 114. The mounting block 130 has a leading end 152 and a loading end 154 and extends therebetween along a longitudinal axis 156 of the connector module 102. In the illustrated embodiment, the mounting block 130 has contact channels 140, 142 that are configured to hold the signal contacts 112, 114, respectively. The contact channels 140, 142 are generally open along a side (e.g., top side) of the mounting block 130 to receive the signal contacts 112, 114 therein, but may have other configurations in alternative embodiments. The mounting block 130 may include features to secure the signal contacts 112, 114 in the respective contact channels 140, 142. For example, the signal contacts 112, 114 may be held by an interference fit therein. In some embodiments, the mounting block 130 and the contact channels 140, 142 are designed for impedance control of the signal contacts 112, 114.

The mounting block 130 is positioned forward of the cable 110. Wire conductors 212, 214 (shown in FIG. 4) from the cable 110 are configured to extend into the mounting block 130 for termination to the signal contacts 112, 114, respectively. The mounting block 130 is shaped to guide or position the wire conductors 212, 214 therein for termination. In an exemplary embodiment, the wire conductors 212, 214 are terminated to the signal contacts 112, 114 in-situ after being loaded into the mounting block 130. For example, the mounting block 130 may position the signal contacts 112, 114 and the wire conductors 212, 214 in direct physical engagement. The signal contacts 112, 114 and the respective wire conductors 212, 214 may then be coupled together (e.g., through welding or soldering).

In an exemplary embodiment, the signal contacts 112, 114 extend forward from the mounting block 130 beyond the leading end 152. The mounting block 130 includes locating posts 158, 160 extending from opposite sides of the mounting block 130. The locating posts 158, 160 are configured to position the mounting block 130 with respect to the ground shield 120 when the ground shield 120 is coupled to the mounting block 130.

The signal contacts 112, 114 may be stamped and formed from conductive sheet material or may be manufactured by other processes. Each of the signal contacts 112, 114 extends lengthwise between a corresponding mating end 172 and a corresponding terminating end (not shown). The signal contacts 112, 114 are configured to be terminated to the wire conductors 212, 214, respectively, at the terminating ends. In an exemplary embodiment, the signal contacts 112, 114 have pins 166 at the mating ends 172. The pins 166 extend forward from the leading end 152 of the mounting block 130. The pins 166 are configured to be mated with corresponding receptacle contacts (not shown) of the receptacle connector (not shown).

The ground shield 120 has a plurality of walls 181-183 that define a first chamber 176 that is configured to receive the contact assembly 104. The ground shield 120 extends between a mating end 178 and a terminating end 180. The mating end 178 is configured to be mated with the receptacle connector. The terminating end 180 is configured to be electrically connected to the cable assembly 108. In the illustrated embodiment, the mating end 178 of the ground shield 120 is positioned either at or beyond the mating ends 172 of the signal contacts 112, 114 when the connector module 102 is assembled. The terminating end 180 of the ground shield 120 is positioned either at or beyond the terminating ends of the signal contacts 112, 114. The ground shield 120 may provide shielding along an entire length of the signal contacts 112, 114.

As shown in FIG. 3, the cable assembly 108 includes a ground ferrule 204 that is coupled to a terminating end 206 of the cable 110. As will be described in greater detail below, the ground ferrule 204 is configured to be electrically coupled to a shielding layer 240 (shown in FIG. 4) of the cable 110. The ground ferrule 204, in turn, may be coupled to the shield assembly 106. For example, the ground shield 120 may be coupled to the ground ferrule 204 through, for example, laser-welding. Accordingly, the shield assembly 106 may be directly coupled to the cable assembly 108 thereby establishing a grounding pathway therebetween.

The ground shield 122 has a plurality of walls 185-187 that define a second chamber 188 that receives the contact assembly 104. The ground shield 122 extends between a mating end 190 and a terminating end 192. The mating end 190 is configured to be mated with the receptacle connector. Similar to the ground shield 120, the ground shield 122 may provide shielding along the length of the signal contacts 112, 114. When the ground shields 120, 122 are coupled together to form the shield assembly 106, the chambers 176, 188 overlap each other (e.g., occupy the same space) to become a contact cavity of the connector module 102. The contact assembly 104 is configured to be positioned within the contact cavity such that the shield assembly 106 peripherally surrounds the contact assembly 104.

Figure 4:
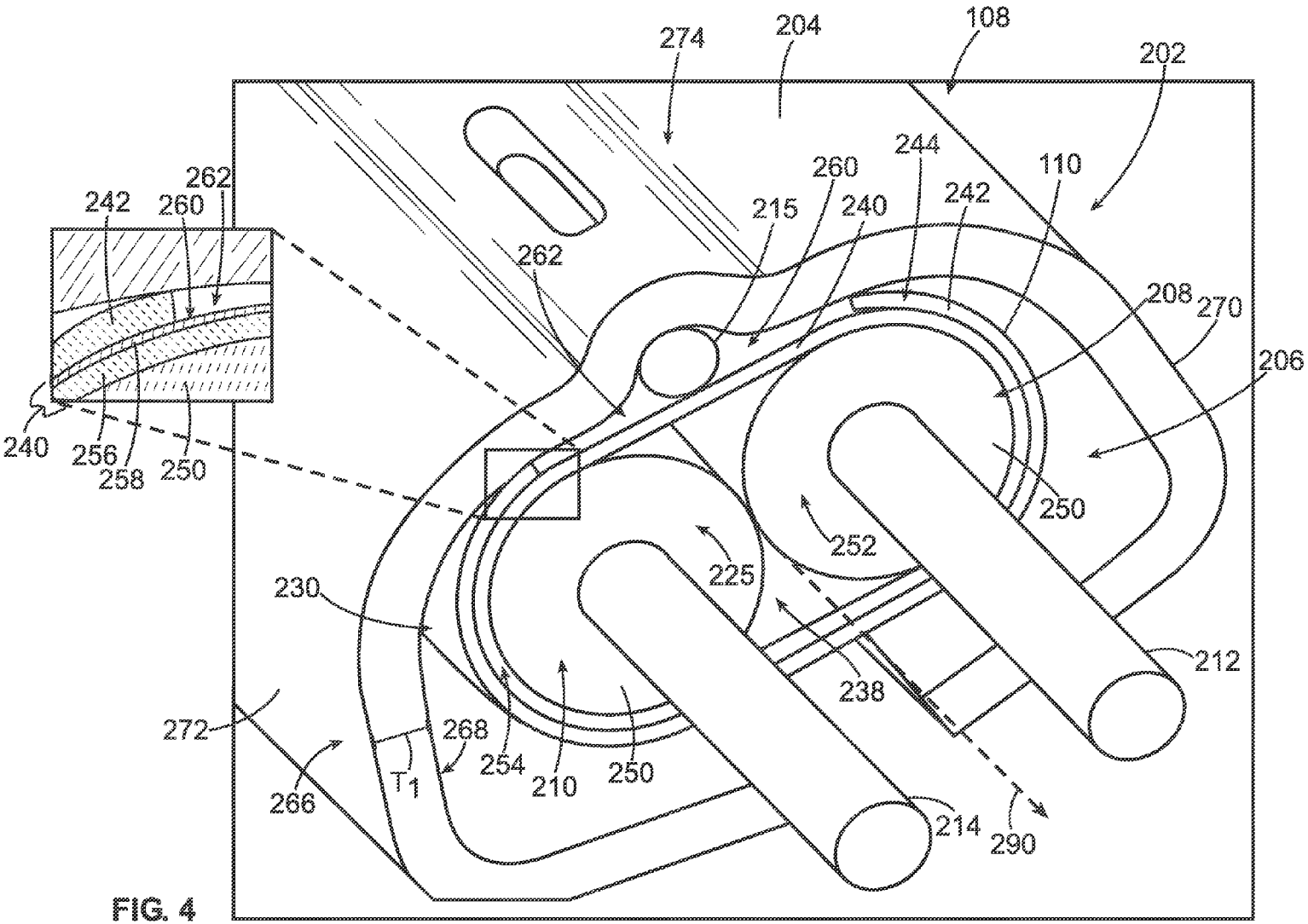
FIG. 4 is a perspective view of an end portion of a cable assembly formed in accordance with one embodiment that may be used with the connector modules of FIG. 1.

FIG. 4 is a perspective view of an end portion 202 of the cable assembly 108. The cable assembly 108 is configured to mechanically and electrically engage the contact assembly 104 (FIG. 1) and mechanically and electrically engage the shield assembly 106 (FIG. 1). The cable assembly 108 includes the cable 110 and the ground ferrule (or shield) 204. The ground ferrule 204 is engaged to the terminating end 206 of the cable 110. In the illustrated embodiment, the cable 110 includes a cable jacket 242, a shielding layer 240, a pair of insulated conductors 208, 210, and a drain wire 215. The cable jacket 242, the shielding layer 240, the insulated conductors 208, 210, and the drain wire 215 may extend along a length of the cable 110 and may extend along a central or longitudinal axis 290 of the cable 110 as shown in FIG. 4. However, it is understood that the cable 110 may be a flexible cable and, as such, the central axis 290 is not required to be linear for the entire length of the cable 110. Instead, the central axis 290 may extend through a geometric center of a cross-section of the cable 110. In the illustrated embodiment, the central axis 290 extends along a tangent line where the insulated conductors 208, 210 interface or contact each other.

In some embodiments, the insulated conductors 208, 210 may extend parallel to each other along the length of the communication cable 110. As such, the cable configuration shown in FIG. 4 may also be referred to as a parallel pair of conductors. However, the parallel-pair configuration of the cable 110 is just one example of the various configurations that the cable 110 may have. For example, the insulated conductors may not extend parallel to each other and, instead, may form a twisted pair of insulated conductors. In other embodiments, the cable 110 may include only a single insulated conductor or more than two insulated conductors. Moreover, the cable 110 may include more than one pair of insulated conductors (e.g., four pairs).

The shielding layer 240 surrounds the insulated conductors 208, 210, and the cable jacket 242 surrounds the shielding layer 240 along an interface 244. As shown, the shielding layer 240 immediately surrounds the insulated conductors 208, 210 such that no other layers of material are located between the shielding layer 240 and the insulated conductors 208, 210. The shielding layer 240 may be tightly wrapped about the insulated conductors 208, 210 such that the insulated conductors are unable to move relative to one another. For instance, the insulated conductors 208, 210 may be arranged side-by-side and held together such that each moves or flexes with the other. However, in alternative embodiments, the shielding layer 240 may be configured to permit some movement of the insulated conductors 208, 210 relative to each other. As shown in FIG. 4, the shielding layer 240 defines a core cavity 238 that includes the insulated conductors 208, 210.

In the illustrated embodiment, the cable jacket 242 immediately surrounds the shielding layer 240 such that no other layers of material are located between the cable jacket 242 and the shielding layer 240. The cable jacket 242 may be applied to the shielding layer 240 through a plastic extrusion process. The cable jacket 242 may also be applied to the shielding layer 240 through a spiral wrapping process. As shown, the cable jacket 242 has an exterior surface 230. The exterior surface 230 may also be the exterior surface of the cable 110. In other embodiments, additional layers of material may be located between the shielding layer 240 and the insulated conductors 208, 210 or between the shielding layer 240 and the cable jacket 242. The cable jacket 242 may also be surrounded by another layer or jacket in other embodiments.

The insulated conductors 208, 210 include the wire conductors 212, 214, respectively, and a corresponding insulation (dielectric) layer 250. The insulation layer 250 surrounds the corresponding wire conductor and electrically separates the wire conductor from the wire conductor of the other insulated conductor. As shown in FIG. 4, the insulation layers 250 of the insulated conductors 208, 210 have been removed (e.g., stripped) thereby defining an insulation end 252 of the insulation layer 250. The wire conductors 212, 214 extend a distance beyond the corresponding insulation ends 252. In the illustrated embodiment, the insulation ends 252 are substantially flush with a shielding end 254 of the shielding layer 240. However, the insulation ends 252 are not required to be flush with the shielding end 254 in other embodiments.

In some embodiments, a portion of the cable jacket 242 may be removed to expose the shielding layer 240. For example, the cable jacket 242 may be removed thermally, mechanically, or chemically to reveal the shielding layer 240. In particular embodiments, the cable jacket 242 is removed using a laser-ablation operation. During the laser-ablation operation, a laser (e.g., $CO_2$ laser) is directed onto the cable jacket 242 to thermally remove the material of the cable jacket 242. More specifically, the material of the cable jacket 242 may be burned off. The laser may be moved back and forth across the communicable cable 110 in a raster-like manner. In the illustrated embodiment, the drain wire 215 is in intimate contact with the ground ferrule 204 and in intimate contact with the shielding layer 240.

As shown in the enlarged portion of FIG. 4, the shielding layer 240 may include a dielectric or plastic sub-layer 256 and a conductive material sub-layer 258 (hereinafter referred to as the conductive sub-layer 258). The conductive sub-layer 258 faces away from the insulation layer 250 such that the dielectric sub-layer 256 is located between the conductive sub-layer 258 and the insulation layer 250. The configuration shown in FIG. 4 may be referred to as a foil-out configuration. In some embodiments, the conductive sub-layer 258 is a conductive foil or plating, which may include, for example, aluminum.

The conductive sub-layer 258 has an electrically conductive exterior surface 260 of the shielding layer 240. For a portion of the cable 110 in which the cable jacket 242 has not been removed, the exterior surface 260 may interface with the cable jacket 242. The conductive sub-layer 258 may be resistant to the removal operation described above. For instance, if the cable jacket 242 is removed using a laser, the laser may be incident on the conductive sub-layer 258, but unable to remove the conductive sub-layer 258. After removing the cable jacket 242, an exposed section 262 of the exterior surface 260 exists. The shielding layer 240 is configured to be electrically grounded at the exposed section 262.

As shown in FIG. 4, the ground ferrule 204 has an exterior surface 266 that faces radially-outward away from the central axis 290, an interior surface 268 that faces radially-inward toward the central axis 290, and a thickness $T_1$ extending therebetween. The interior surface 268 is configured to interface with the cable 110. More specifically, the interior surface 268 of the ground ferrule 204 may substantially interface with the exterior surface 230 of the cable jacket 242 or the exterior surface 260 of the shielding layer 240 along the exposed section 262.

In the illustrated embodiment, the ground ferrule 204 includes first and second arms 270, 272 and a wire-accommodating portion 274 that is located between the arms 270, 272. The ground ferrule (or shield) 204 is configured to surround at least a portion of and couple to the terminating end 206 of the cable 110. For example, the ground ferrule 204 may be formed or shaped (e.g., bent or rolled) to surround the terminating end 206 of the cable 110 about the central axis 290. The ground ferrule 204 may comprise a metallic material that is suitably conductive for allowing a grounding pathway to propagate through the ground ferrule 204 and a portion of an electrical component, such as the ground shield 120 (FIG. 2). To grip the terminating end 206, the material of the ground ferrule 204 may be positioned along the terminating end 206 and deformed or pressed radially inwardly toward the central axis 290 such that the interior surface 268 grips the cable 110. A tool or machine may be used to apply the ground ferrule 204. For example, a crimping tool may be configured to shape and press the ground ferrule 204 against the cable 110.

In the illustrated embodiment, the drain wire 215 is positioned between the ground ferrule 204 and the exposed section 262 of the exterior surface 260 of the cable 110. During application of the ground ferrule 204, the interior surface 268 of the ground ferrule 204 is pressed against the drain wire 215 to form an intimate engagement therebetween. Moreover, the drain wire 215 may be pressed against the exterior surface 260 by the ground ferrule 204.

Figure 5:
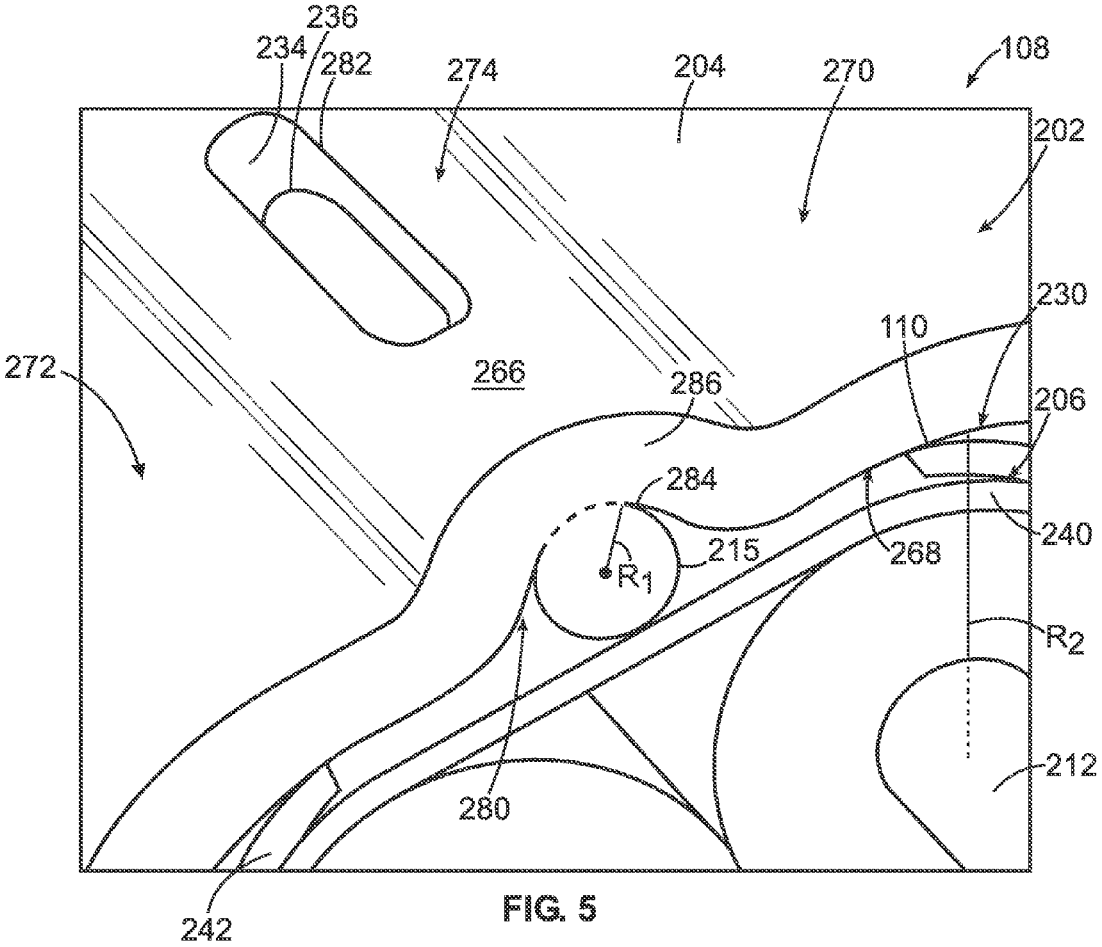
FIG. 5 shows an enlarged view of the end portion of the cable assembly of FIG. 4.

FIG. 5 shows an enlarged view of the end portion 202 of the cable assembly 108. The ground ferrule 204 is configured to be intimately engaged with the drain wire 215 along a contact zone or interface 284. In FIG. 5, the contact zone 284 is referenced with a bolded and dashed line which indicates where the interior surface 268 of the ground ferrule 204 is in intimate contact with the drain wire 215. When the cable assembly 108 is fully assembled or the connector module 102 (FIG. 1) is fully assembled, the ground ferrule 204 may be welded to the drain wire 215 along at least a portion of the contact zone 284. The contact zone 284 may extend from a ferrule edge 286 of the ground ferrule 204 along the central axis 290 (FIG. 4) toward an opposite edge (not shown) of the ground ferrule 204. In particular embodiments, the contact zone 284 is along the wire-accommodating portion 274.

As shown, the arms 270, 272 may be shaped (e.g., deformed) to substantially conform to a contour of the cable jacket 242. The wire-accommodating portion 274 is configured to engage and immediately surround the drain wire 215 along the contact zone 284. In some embodiments, the wire-accommodating portion 274 may be shaped to conform to the contour of the drain wire 215 before the ground ferrule 204 is coupled to the terminating end 206. For example, sheet material may be stamped and formed to include the wire-accommodating portion 274. Alternatively, the wire-accommodating portion 274 may conform to the contour of the drain wire 215 as the ground ferrule 204 is being coupled to the terminating end 206 (e.g., as the ground ferrule 204 is undergoing a crimping process).

When the ground ferrule 204 is coupled to the terminating end 206 as shown in FIG. 5, the interior surface 268 along the arms 270, 272 may be substantially pressed against the exterior surface 230 of the cable 110 (e.g., the cable jacket 242) and the interior surface 268 may be pressed against the drain wire 215. The drain wire 215 is located between the ground ferrule 204 and the shielding layer 240. As shown, the wire-accommodating portion 274 may define a cradle recess 280 along the interior surface 268. In the illustrated embodiment, the cradle recess 280 is sized and shaped to receive the drain wire 215 such that the wire-accommodating portion 274 of the ground ferrule 204 surrounds the drain wire 215. More specifically, the portion of the interior surface 268 that extends along the drain wire 215 may jut away from the cable 110 and wrap around the drain wire 215 so that the drain wire 215 may be received. The portions of the interior surface 268 that extend along the cable jacket 242 may interface with the exterior surface 230 and have a similar or substantially similar contour as the cable jacket 242.

The interior surface 268 may have different contoured sections or portions. The different contoured sections may have different contours based on the portions of the cable 110 that the interior surface 268 interfaces. For instance, the interior surface 268 may be described as having portions with different radiuses of curvature. As one particular example, the portion of the interior surface 268 that corresponds to the contact zone 284 may have a first radius of curvature $R_1$ and the portion of the interior surface 268 that interfaces with the cable jacket 242 may have a second radius of curvature $R_2$. The wire-accommodating portion 274 may include the radius of curvature $R_1$, and the arms 270, 272 may have the radius of curvature $R_2$. In the illustrated embodiment, the radius of curvature $R_1$ is based on dimensions of the drain wire 215. For example, a center of a circle that defines the radius of curvature $R_1$ may extend substantially through a center of the drain wire 215. In the illustrated embodiment, the radius of curvature $R_2$ is based on dimensions of the insulated conductors 208, 210 (FIG. 4). For example, a center of a circle that defines the radius of curvature $R_2$ may extend substantially through a center of the wire conductor 212 or the wire conductor 214 (FIG. 4). As shown in FIG. 5, the first radius of curvature $R_1$ may be smaller that the second radius of curvature $R_2$. By way of example only, a ratio between the radius of curvatures $R_1$ and $R_2$ may be between about 1:3 and about 1:10. More particularly, the ratio between the radius of curvatures $R_1$ and $R_2$ may be between about 1:4 and about 1:6.

In some embodiments, the ground ferrule 204 includes a bonding channel 282 that overlaps the drain wire 215. In the illustrated embodiment, the bonding channel 282 is elongated and extends along at least a portion of the drain wire 215. The bonding channel 282 may extend parallel to the central axis 290 (FIG. 4) and may extend through the wire-accommodating portion 274. In other embodiments, the bonding channel 282 may not be elongated. For example, the bonding channel 282 may be a circular hole or opening.

The bonding channel 282 may be defined by a channel surface 234 of the ground ferrule 204 that extends from the exterior surface 266 toward the drain wire 215. The contact zone 284 may be the interface between the drain wire 215 and the ground ferrule 204 or, more specifically, the drain wire 215 and the interior surface 268 that surrounds the bonding channel 282. The bonding channel 282 is partially defined by a channel edge 236 that is defined by an intersection between the channel surface 234 and the interior surface 268. The channel edge 236 may engage the drain wire 215. As described below, the bonding channel 282 may facilitate bonding the ground ferrule 204 to the drain wire 215 to establish a ground pathway between the shielding layer 240 and, for example, the ground shield 120 (FIG. 2).

Figure 6:
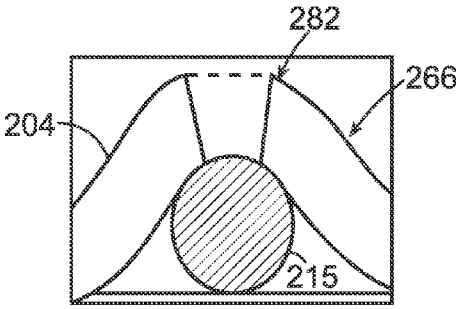
FIG. 6 is a cross-section taken along a contact zone of the cable assembly of FIG. 4.
Figure 7:
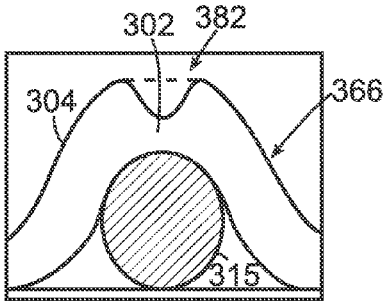
FIG. 7 is a cross-section taken along a contact zone of a cable assembly.

FIG. 6 shows a cross-section of the bonding channel 282, and FIG. 7 shows a cross-section of a bonding channel 382 in a ground ferrule 304 in accordance with an alternative embodiment. The bonding channel 282 may extend from the exterior surface 266 toward the drain wire 215. As shown, at least a portion of the bonding channel 282 extends completely through the ground ferrule 204 thereby forming a window that exposes the drain wire 215 to an exterior of the cable assembly 108 (FIG. 1). With respect to the alternative embodiment shown in FIG. 7, the bonding channel 382 may extend from an exterior surface 366 toward a drain wire 315. However, the bonding channel 382 may not extend completely through the ground ferrule 304. Instead, a reduced portion 302 of material may exist between the exterior surface 366 and the drain wire 315 along the bonding channel 382.

Figure 8:
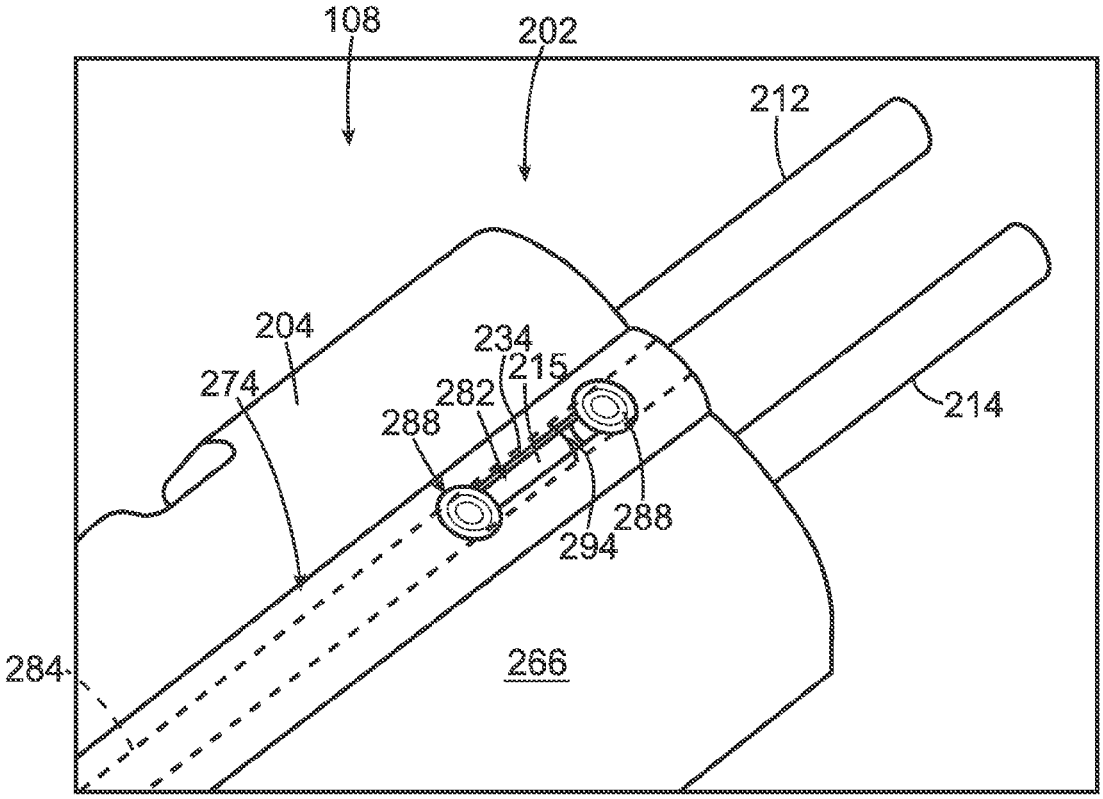
FIG. 8 is a perspective view of the end portion of the cable assembly of FIG. 4 in which a portion of the contact zone has been welded.

FIG. 8 is a perspective view of the end portion 202 of the cable assembly 108 in which a portion of the contact zone 284 (indicated by dashed lines) has been welded. In one or more embodiments, the ground ferrule 204 may be laser-welded to the drain wire 215 using a welding process. To weld the ground ferrule 204 to the drain wire 215, a welding beam (e.g., 532 nm green laser welding beam) may be directed into the bonding channel 282 to a beam spot that is incident upon the drain wire 215 and/or the channel surface 234 that defines the bonding channel 282. Heat is generated at or around the beam spot in the ground ferrule 204 and the drain wire 215. The material of the ground ferrule 204 and the material of the drain wire 215 may melt together and form a material "puddle" around where the beam spot is located. Subsequent cooling of the material puddle forms a mechanical and electrical connection (i.e., a metallurgical or welding bond 288) between the metal materials of the ground ferrule 204 and the drain wire 215. The metallurgical bonds 288 may be referred to as welding bonds 288.

Accordingly, the ground ferrule 204 may be welded to the drain wire 215. The ground ferrule 204 may include a plurality of welding bonds 288. As shown, the wire-accommodating portion 274 includes two welding bonds 288. In alternative embodiments, only a single welding bond may be used or more than two welding bonds may be used. In the illustrated embodiment, the two welding bonds 288 are spaced apart from each other. In other embodiments, a welded seam may be formed. For example, the welding bonds 288 may be aligned and located immediately adjacent to each other (or overlap each other) to form a substantially continuous seam of bonds. In other embodiments, a single elongated bond may be formed by relatively moving the beam spot along the bonding channel 282 thereby forming the welded seam.

In some cases, the welding bonds 288 may be identifiable through inspection of the cable assembly 108 using, for example, a scanning electron microscope (SEM) or other microscope. For instance, the exterior surface 266 of the ground ferrule 204 along the welding bond(s) 288 may be morphologically uneven or have changes in color, changes in luster, or some other identifiable change with respect to the surrounding area that is indicative of a welding bond. By way of one example, the welding bonds 288 may have a recessed surface with respect to the surrounding area of the ground ferrule 204. The changes may also be identified when viewing a cross-section of the ground ferrule 204 and the drain wire 215. In some embodiments, a portion of the bonding channel 282 may remain after the ground ferrule 204 and the drain wire 215 are bonded through laser-welding.

The diameter of the beam spot and the various dimensions of the bonding channel 282 and the drain wire 215 may be configured to provide suitable welding bonds. For instance, the welding beam may have a beam diameter that is greater than or less than a width 294 of the bonding channel 282. By way of example only, the width 294 may be about 0.13 mm to about 0.25 mm and, more particularly, about 0.18 mm. The beam diameter may be about 0.13 mm to about 0.38 mm or, more particularly, about 0.25 mm. In some embodiments, the width 294 of the bonding channel 282 may be about 25% to about 75% of the diameter of the welding beam (or, more specifically, the diameter of the beam spot). The thickness $T_1$ (FIG. 4) of the ground ferrule 204 may be about 0.10 to about 0.20 mm and, more particularly, about 0.15 mm.

In other embodiments, the cable assembly 108 is laser-welded using a lap-welding process. In such embodiments, the material of the ground ferrule 204 may at least partially transmit the welding beam. For example, a 532 nm wavelength (green) laser may be used that is only partially absorbed by the ground ferrule 204. A heat spot (not shown) may be generated at an interface between the ground ferrule 204 and the drain wire 215. Thermal energy generated at the heat spot causes the ground ferrule 204 and the drain wire 215 to melt. Subsequent cooling forms the mechanical and electrical connection (i.e., the welding bond).

The laser-welding operation may be performed before, after, or during termination of the wire conductors 212, 214 to the signal contacts 112, 114 (FIG. 1), respectively. After the drain wire 215 and the ground ferrule 204 are laser-welded, the ground shield 120 and/or the ground shield 122 (FIG. 2) may be laser-welded to the ground ferrule 204 using the same laser or a different laser.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable assembly comprising:

a communication cable comprising insulated conductors, a conductive shielding layer that surrounds the insulated conductors, and a drain wire that extends along the shielding layer, wherein the insulated conductors, the shielding layer, and the drain wire extend along a length of the cable to a terminating end of the cable; and a ground ferrule coupled to the terminating end of the cable, the ground ferrule and the shielding layer each engaging the drain wire to hold the drain wire therebetween such that the ground ferrule is intimately engaged with the drain wire along a contact zone, wherein the ground ferrule and the drain wire are laser-welded together for at least a portion of the contact zone.

2. The cable assembly of claim 1, wherein the ground ferrule has an interior surface that extends alongside the cable, the ground ferrule including a wire-accommodating portion that defines a cradle recess along the interior surface, the cradle recess being shaped to receive the drain wire such that the wire-accommodating portion surrounds the drain wire.

3. The cable assembly of claim 2, wherein the wire-accommodating portion forms a welding bond between the drain wire and the ground ferrule, the welding bond including material of the ground ferrule and material of the drain wire.

4. The cable assembly of claim 2, wherein the wire-accommodating portion includes a bonding channel that extends from an exterior surface of the ground ferrule toward the drain wire in the cradle recess, the ground ferrule being welded to the drain wire along the bonding channel.

5. The cable assembly of claim 1, wherein the ground ferrule has an exterior surface and an interior surface that extends alongside the cable, the ground ferrule including a bonding channel that extends from the exterior surface of the ground ferrule toward the drain wire, the ground ferrule being welded to the drain wire along the bonding channel.

6. The cable assembly of claim 5, wherein at least a portion of the bonding channel extends completely through the ground ferrule forming a window that exposes the drain wire.

7. The cable assembly of claim 1, wherein a plurality of welding bonds join the drain wire and the ground ferrule, each of the welding bonds including material of the ground ferrule and material of the drain wire.

8. The cable assembly of claim 1, wherein the insulated conductors form a parallel pair of the insulated conductors.

9. The cable assembly of claim 1, wherein each of the insulated conductors includes a corresponding wire conductor that is surrounded by a corresponding insulation layer, the wire conductors extending beyond the insulation layer at the terminating end.

10. The cable assembly of claim 1, wherein the shielding layer includes a conductive sub-layer having an electrically conductive exterior surface of the shielding layer, the exterior surface of the shielding layer facing away from the insulated conductors and directly engaging the drain wire.

11. The cable assembly of claim 10, wherein the ground ferrule presses the drain wire against the exterior surface of the shielding layer to form an intimate engagement between the drain wire and the exterior surface of the shielding layer.

12. The cable assembly of claim 1, further comprising a cable jacket that surrounds the shielding layer, the cable jacket extending only partially around the shielding layer at the terminating end such that an exposed section of the shielding layer exists, wherein the ground ferrule includes a wire-accommodating portion that extends over the exposed section and at least one arm that extends around and engages an exterior surface of the cable jacket, the wire-accommodating portion and the shielding layer holding the drain wire therebetween.

13. A cable assembly comprising:

a communication cable comprising insulated conductors, a shielding layer that surrounds the insulated conductors, and a drain wire that extends along the shielding layer, wherein the insulated conductors, the shielding layer, and the drain wire extend along a length of the cable to a terminating end of the cable; and a ground ferrule coupled to the terminating end of the cable, the ground ferrule being intimately engaged with the drain wire along a contact zone, wherein the ground ferrule and the drain wire are laser-welded together for at least a portion of the contact zone;

wherein the ground ferrule has an interior surface that extends alongside the cable, the interior surface having a first radius of curvature along the drain wire and a second radius of curvature along an exterior surface of the cable, the first radius of curvature being smaller than the second radius of curvature.

14. A cable connector comprising:

a housing having a mating face configured to engage a mating connector; and a plurality of connector modules supported by the housing and arranged along the mating face, at least one of the connector modules comprising:

a communication cable comprising insulated conductors, a shielding layer that surrounds the insulated conductors, and a drain wire that extends along the shielding layer, wherein the insulated conductors, the shielding layer, and the drain wire extend along a length of the cable to a terminating end of the cable;

a contact assembly comprising signal contacts, the signal contacts being electrically coupled to the insulated conductors of the cable; and a ground ferrule coupled to the terminating end of the cable, the ground ferrule being intimately engaged with the drain wire along a contact zone, wherein the ground ferrule and the drain wire are laser-welded together through a plurality of welding bonds or a weld seam formed along at least a portion of the contact zone, the welding bonds or the weld seam including material from an edge of the ground ferrule and material of the drain wire.

15. The cable connector of claim 14, wherein the ground ferrule has an interior surface that extends alongside the cable, the interior surface having a first radius of curvature along the drain wire and a second radius of curvature along an exterior surface of the cable, the first radius of curvature being smaller than the second radius of curvature.

16. The cable connector of claim 14, wherein the ground ferrule has an interior surface that extends alongside the cable, the ground ferrule including a wire-accommodating portion that defines a cradle recess along the interior surface, the cradle recess being shaped to receive the drain wire such that the drain wire is located between the ground ferrule and the shielding layer.

17. The cable connector of claim 14, wherein the ground ferrule includes a bonding channel that is defined by the edge of the ground ferrule, the edge extending from an exterior surface of the ground ferrule to the drain wire.

18. The cable connector of claim 14, wherein the ground ferrule and the shielding layer each engage the drain wire to hold the drain wire therebetween.

19. The cable connector of claim 14, wherein the connector modules form a two-dimensional array along the mating face, the array including multiple rows and multiple columns of the connector modules.

20. The cable connector of claim 19, wherein each connector module includes only two of the signal contacts and a ground shield that surrounds the two signal contacts.

* * * * *